US005119052A

United States Patent [19]

Witkowski et al.

[11] Patent Number: 5,119,052

[45] Date of Patent: Jun. 2, 1992

[54] GAAS MONOLITHIC WAVEGUIDE SWITCH

[75] Inventors: Larry C. Witkowski; Hua Q. Tserng; Robert C. Voges, all of Dallas; Charles M. Rhoads; Oren B. Kesler, both of Plano, all of Tex.

[73] Assignee: Texas Instruments Incorporated, Dallas, Tex.

[21] Appl. No.: 601,557

[22] Filed: Oct. 23, 1990

[51] Int. Cl.[5] ..... H01P 1/15

[52] U.S. Cl. ..... 333/258; 333/103

[58] Field of Search ..... 333/103, 258

[56] References Cited

U.S. PATENT DOCUMENTS 4,387,386 6/1983 Garver ..... 357/22 H

OTHER PUBLICATIONS

Armstrong et al., *High-Power Waveguide Diode-Array-Switch Element*, MSN&CT, Nov. 1987, pp. 8-19.

Bharj et al., *MESFET Switch Design*, MSN&CT, Nov. 1987, pp. 76-86.

*Primary Examiner*—Paul Gensler

*Attorney, Agent, or Firm*—Richard L. Donaldson; Richard Stoltz; Rene E. Grossman

[57] ABSTRACT

A GaAs monolithic waveguide switch and system for low power consumption and high frequency switching wherein a single GaAs chip is flip-chip mounted onto a waveguide slot and inserted between interconnecting waveguides to provide single pole single throw switching. The GaAs chip includes an array of MESFETs along with connecting electrodes configured to provide low loss in the biased state and high loss in the unbiased state. The use of a single GaAs monolithic chip provides improved RF performance and manufacturability over discrete devices and provides lower power consumption as compared with silicon PIN diode waveguide switches.

12 Claims, 1 Drawing Sheet

GAAS MONOLITHIC WAVEGUIDE SWITCH

BACKGROUND OF THE INVENTION

1. Field of the Invention

This invention relates to a gallium arsenide FET monolithic waveguide switch capable of providing single pole, single throw switching, generally at waveguide junctions.

2. Brief Description of the Prior Art

Prior art waveguide switches have generally been based upon silicon technology. Silicon PIN diodes have been used successfully as microwave and millimeter wave waveguide switches as described in "Microwave Semiconductor Devices and Their Circuit Applications", H. Watson, Editor, McGraw-Hill, 1969, Chapters 9 and 10, "Microwave Diode Control Devices", by R. M. Ryder et al., Microwave Journal, Vol. 11, pp. 57 to 64, Feb. 1968 and pp. 115 to 122, Mar. 1968, "Microwave Semiconductor Control Devices", by K. E. Mortenson, Microwave Journal, Vol. 7, pp. 49 to 57, May 1964, "Millimeter Wave High Power Solid State Limiter", by A. Armstrong et al., Microwave Journal, March 1983 and "Microwave Silicon Windows for High, Power Broad-Band Switching Applications", by K. E. Mortenson, Journal of Solid-State Circuits, Vol SC-4, No. 6, Dec. 1969.

Waveguide switches of the type described in the above noted publications require large amounts of current drive and are fabricated on relatively lossy substrates. For system application, it is important to minimize power consumption and maximize RF performance. GaAs MESFETs on the other hand require virtually no drive power and are fabricated on low loss semi-insulating material U.S. Pat. No. 4,387,386 suggests the use of GaAs MESFETs as a microwave switch. However, the use of GaAs MESFETs in monolithic form for waveguide switches has apparently not previously been explored.

SUMMARY OF THE INVENTION

In accordance with the present invention, GaAs MESFET technology is combined with silicon PIN diode waveguide switch technology to produce an improved, novel waveguide switch over prior art devices. This novel switch uses a single chip GaAs monolithic integrated circuit within a waveguide iris (slot) to perform waveguide switching. The GaAs chip includes an array of MESFETs along with interconnecting electrodes to provide low loss in the biased state and high isolation in the unbiased state while consuming virtually no power. The chip is preferably flip-chip mounted onto a waveguide slot and inserted between interconnecting waveguides to provide single pole, single throw switching. MESFETs, unlike PIN diodes, require voltage to switch from conducting to non-conducting state. The only current that is required to switch the MESFETs is the leakage current (usually microamperes) of the gate diode. The use of a single GaAs monolithic chip provides improved RF performance and manufacturability over discrete devices and offers lower power consumption over silicon PIN diode waveguide switches. Devices of this type can be used, for example, in phase array radar and other systems.

DESCRIPTION OF THE PREFERRED EMBODIMENT

Figure 1:
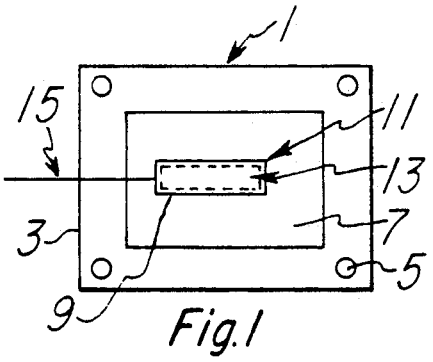
FIG. 1 is a front view of a waveguide end portion having a low loss metal insert with GaAs chip at an aperture in the insert for providing the desired switching action.

Referring first to FIG. 1, there is shown a monolithic GaAs waveguide switch which can be coupled to the outlet ports of a pair of waveguides in accordance with the present invention. There is shown the terminal end 3 of a first waveguide 1 of the waveguides to be interconnected with screw holes 5 for connecting the waveguide end 3 to the end of another waveguide. A low loss metal insert 7 of standard type having a central slot 9 is secured to the waveguide terminal end 3 and closes the entire waveguide terminal end except for the central slot 9 therein. A GaAs chip 11 is secured to the insert 7 and is disposed in the slot 9 thereof to cover the entire slot, the chip including a central portion which acts as a waveguide slot 13 through which microwave energy from the waveguide can travel. A single isolated bias electrode 15 is connected from the chip 11 to the outside of the waveguide. When dc bias is applied to the electrode 15, the waveguide slot 13 is open or closed (short circuited).

The MESFETs in the GaAs chip 11 act as a dielectric load with variable conductivity to enable the slot 13 to be opened or closed. The MESFETs act as the variable conducting medium. The slot 13 provides a bandpass filter response within the waveguide 1.

Figure 2:
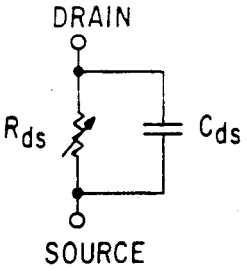
FIG. 2 is a circuit schematic diagram of an FET at zero and pinchoff bias.

FIG. 2 is a circuit schematic diagram of a FET at zero and pinchoff bias. GaAs MESFETs have low drain to source ($R_{ds}$) resistance at zero bias and high $R_{ds}$ resistance at pinchoff bias. A capacitance $C_{ds}$ is in shunt with this variable resistance. Typical zero bias resistance is 2 ohms per mm of gate width and several thousand ohms at pinchoff bias. The source to drain capacitance is typically 0.3 pF per mm of gate width. Placing a FET in shunt within a waveguide therefore appears as a short circuit at zero bias and an open circuit at pinchoff bias. The FET gate width must be chosen such that the FET appears as substantially a short circuit (small resistor) at zero bias as well as a substantially open circuit (low capacitance) at pinchoff bias.

Figure 3:
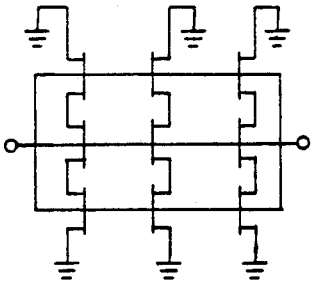
FIG. 3 is a circuit diagram of an FET array as would be provided on a chip in accordance with the present invention.

To reduce the capacitance and resistance within the waveguide, a series/parallel array of FETs is configured across the waveguide slot. One such configuration of an FET array is shown in FIG. 3. Increasing the number of parallel elements increases the isolation by short circuiting out the electric field while increasing series elements reduces the effective capacitance. By placing all of the FETs onto a single GaAs monolithic chip, parasitics are minimized.

The geometry of FETs and interconnecting electrodes must be considered to the design of the switch. Any metallic geometry within the waveguide will introduce a susceptance which will degrade the performance of the switches. The size and location of each element within the waveguide slot must be carefully chosen to minimize electric field disturbances. Lines perpendicular to the electric field will cause only a minimal disturbance while parallel lines will cause a large disturbance. These disturbances translate into switch losses. The FETs and gate interconnecting lines are therefore placed perpendicular to the electric field. The source/-drain lines which are placed parallel to the electric field are made small to minimize their disturbance. The contact areas of the FETs are also minimized to reduce field disturbances.

Figure 4:
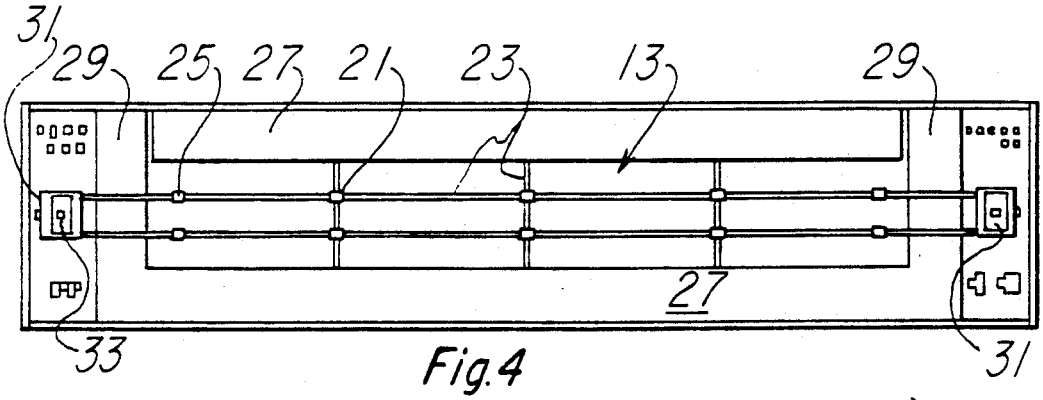
FIG. 4 is a detailed top view of the chip of FIG. 1.

A typical such GaAs MESFET chip 11 is shown in FIG. 4. The chip has formed thereon a plurality of MESFETS 21 which are interconnected with gold interconnect leads 23. Bond pads 25 are disposed at spaced locations on the interconnect leads 23. A layer of gold 27 is disposed along opposed edges and is used to bond the chip 11 to the insert 7 by soldering as well as providing a ground contact. The waveguide slot 13 of FIG. 1 is the spacing in the chip 11 between the gold sections 27 and side gold sections 29. The interconnect leads 23 are spaced over the gold sections 29 by an air bridge or other appropriate separation method. The interconnect leads 23 also terminate at bond pads 31 which extend through a via 33 therein through the chip to the backside of the chip and make contact with backside metallization (not shown). The slot 9 in the insert 7 is slightly larger than the waveguide slot 13 to allow the precise dimensions of the chip to be used as the waveguide slot. This reduces chip to slot alignment tolerances and also slot machining tolerances.

Figure 5:
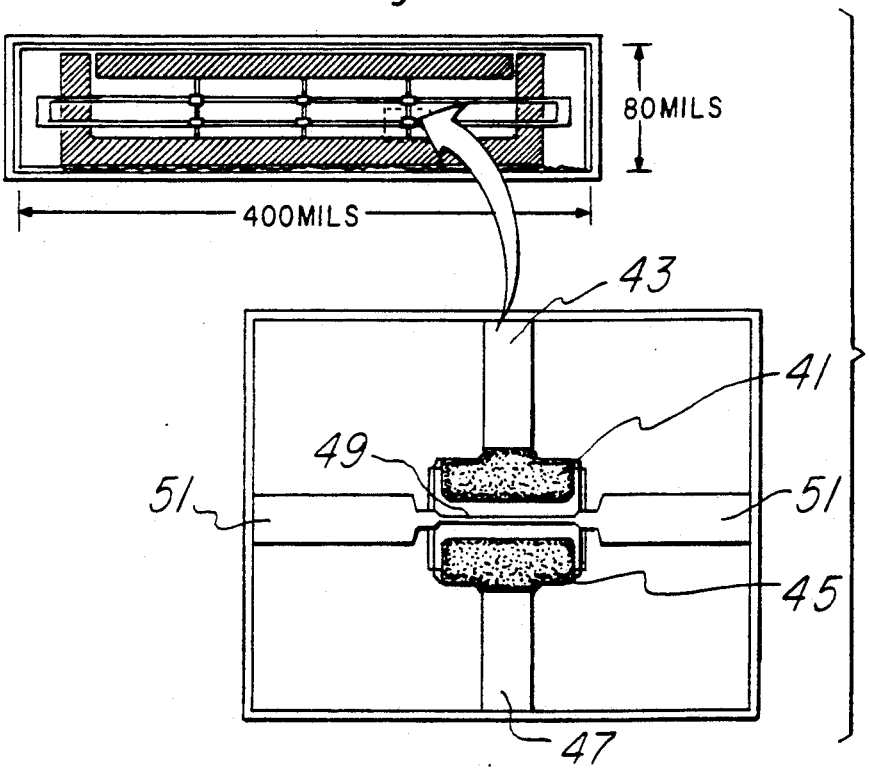
FIG. 5 is a top view of a typical MESFET which is a portion of the circuitry of the chip of FIG. 4.

Referring now to FIG. 5, there is shown a typical MESFET 21 of the type shown in FIG. 4. The MESFET includes a drain region with a drain contact 41 thereon connected to an interconnect 43 which is a portion of the interconnect system 23 shown in FIG. 4. Also, the source region has a source contact 45 thereon connected to an interconnect 47 which is also a portion of the interconnect system 23 The gate contact 49 is connected to an interconnect 51 which is also a portion of the interconnect system 23. The interconnect 51 is the horizontal portion of the interconnect system 23 whereas the drain interconnect 43 extends from the MESFET 21 upwardly and the source interconnect 47 extends from the MESFET downwardly.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

We claim:

1. A waveguide switch comprising:

(a) a low loss insert including a coupling device thereon to couple said insert to a waveguide, said insert including a central slot;

(b) a monolithic GaAs semiconductor chip secured to said insert about the periphery of said central slot and completely covering said slot, said chip including a plurality of active MESFET semiconductor devices thereon and interconnects coupling together said active MESFET semiconductor devices, said chip providing a waveguide slot for a waveguide couplable to said insert;

(c) a bias connection coupled to said chip for controlling operation of said chip.

2. The switch of claim 1 wherein said insert is a metal.

3. The switch of claim 2 wherein said chip includes a surface having an electrically conductive layer disposed at the periphery thereof, said electrically conductive layer lying at least in part over said insert and defining said waveguide slot, said active MESFET semiconductor devices being disposed within said electrically conductive layer.

4. The switch of claim 3 further including metallization on a surface of said chip opposed to said surface having an electrically conductive layer disposed at the periphery thereof and a via in said chip extending from said electrically conductive layer to said metallization.

5. The switch of claim 1 wherein said ship includes a surface having an electrically conductive layer disposed at the periphery thereof, said electrically conductive layer lying at least in part over said insert and defining said waveguide slot, said active MESFET semiconductor devices being disposed within said electrically conductive layer.

6. The switch of claim 5 further including metallization on a surface of said chip opposed to said surface having an electrically conductive layer disposed at the periphery thereof and a via in said chip extending from said electrically conductive layer to said metallization.

7. A waveguide switching system comprising:

(a) a waveguide switch including:

(b) a low loss insert including a coupling device thereon to coupled said insert to a waveguide, said insert including a central slot;

(c) a monolithic GaAs semiconductor chip secured to said insert about the periphery of said central slot and completely covering said slot, said chip including a plurality of active MESFET semiconductor devices thereon and interconnects coupling together said active MESFET semiconductor devices, said chip providing a waveguide slot for a waveguide coupled to said insert;

(d) a bias connection coupled to said chip for controlling operation of said chip; and (e) a pair of interconnected waveguides, said waveguide switch coupled to said waveguides at a surface of interconnection therebetween.

8. The system of claim 7 wherein said insert is a metal.

9. The system of claim 8 wherein said chip includes a surface having an electrically conductive layer disposed at the periphery thereof, said electrically conductive layer lying at least in part over said insert and defining said waveguide slot, said active MESFET semiconductor devices being disposed within said electrically conductive layer.

10. The system of claim 9 further including metallization on a surface of said chip opposed to said surface having an electrically conductive layer disposed at the periphery thereof and a via in said chip extending from said electrically conductive layer to said metallization.

11. The system of claim 7 wherein said chip includes a surface having an electrically conductive layer disposed at the periphery thereof, said electrically conductive layer lying at least in part over said insert and defining said waveguide slot, said active MESFET semiconductor devices being disposed within said electrically conductive layer.

12. The system of claim 11 further including metallization a surface of said chip opposed to said surface having an electrically conductive layer disposed at the periphery thereof and a via in said chip extending from said electrically conductive layer to said metallization.

* * * * *